US006715622B2

(12) United States Patent
Keenan et al.

(10) Patent No.: US 6,715,622 B2
(45) Date of Patent: Apr. 6, 2004

(54) DECORATIVE CATERING DEVICE FOR DISPLAYING AND SERVING INDIVIDUAL-SERVING-SIZE APPETIZERS

(76) Inventors: Julie E. Keenan, 112 Brookline Blvd., Havertown, PA (US) 19083; Timothy M. Rupp, 1501 Darby Rd., Havertown, PA (US) 19083

( * ) Notice: Subject to any disclaimer, the term of this patent is extended or adjusted under 35 U.S.C. 154(b) by 28 days.

(21) Appl. No.: 09/812,281

(22) Filed: Mar. 20, 2001

(65) Prior Publication Data

US 2002/0134743 A1 Sep. 26, 2002

(51) Int. Cl.[7] ..... A47F 7/00

(52) U.S. Cl. ..... 211/85.4; 211/205; D6/450; D6/449; D7/505

(58) Field of Search ..... 211/85.4, 113, 211/205; D6/449, 450, 466, 467; D7/704, 702, 368, 505, 506, 550.1, 551.2, 558

(56) References Cited

U.S. PATENT DOCUMENTS

| | | | | | |
|---|---|---|---|---|---|
| D97,306 | S | * | 10/1935 | Schuelke | D6/453 |
| 2,760,052 | A | | 8/1956 | Owen | 362/127 |
| 3,651,601 | A | | 3/1972 | La Montagne | 47/41.12 |
| 4,040,520 | A | | 8/1977 | Joaquin | 211/163 |
| 4,925,426 | A | * | 5/1990 | Lovik | 428/12 |
| 4,937,109 | A | | 6/1990 | Lin | 248/27.8 |
| 5,070,644 | A | | 12/1991 | Hasty | 47/41.12 |
| 5,094,348 | A | | 3/1992 | Harris et al. | 211/60.1 |
| 5,201,194 | A | * | 4/1993 | Flynn et al. | 62/457.2 |
| 5,634,569 | A | * | 6/1997 | DeCoster | 206/519 |
| 5,772,050 | A | * | 6/1998 | Shih | 211/205 |
| D436,798 | S | * | 1/2001 | Adamson | D7/368 |

* cited by examiner

*Primary Examiner*—Daniel P. Stodola
*Assistant Examiner*—Erica B. Harris
(74) *Attorney, Agent, or Firm*—Joseph M. Konieczny

(57) ABSTRACT

A device for displaying and serving individual-serving-size food items, such as bite-size appetizers. The device has a pedestal, a head fixed to and supported by the pedestal, and spikes for releasably fixing a plurality of the individual-serving-size food items on the head. The pedestal comprises a base and an upwardly-extending support member having an upper end fixed to the head and a lower end fixed to the base. The base includes a receptacle for containing and serving a complimentary accouterment to the appetizer such as a dipping sauce or marinade. The receptacle is removable from the base for filling, emptying and storing the food item contained therein. Preferably, all of the components of the device can be disassembled for cleaning and compact storage.

20 Claims, 2 Drawing Sheets

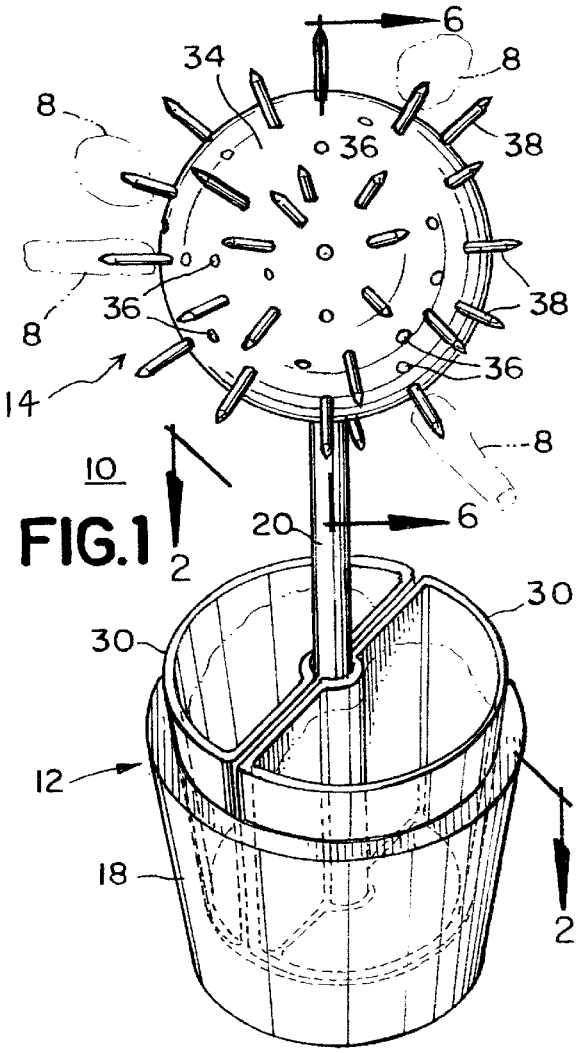
FIG.1
FIG.3
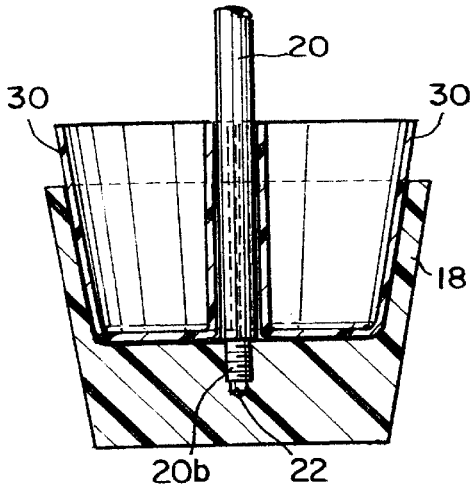
FIG. 4
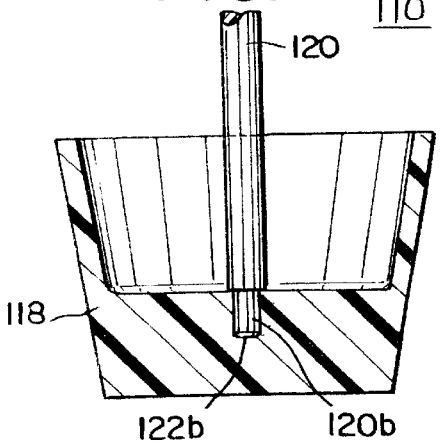
FIG.2
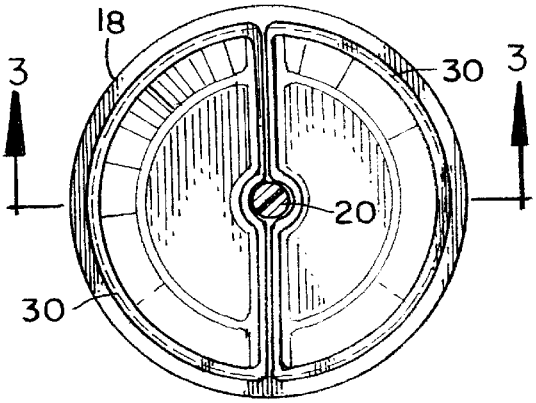
FIG.5
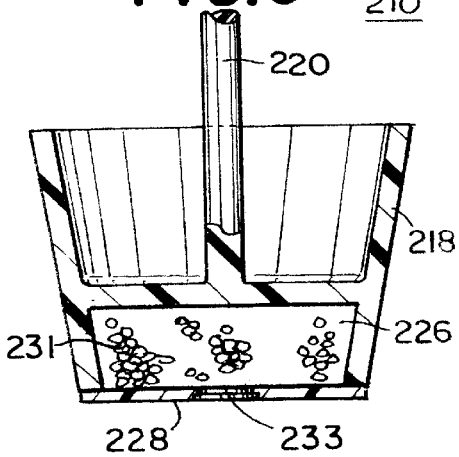

DECORATIVE CATERING DEVICE FOR DISPLAYING AND SERVING INDIVIDUAL-SERVING-SIZE APPETIZERS

FIELD OF THE INVENTION

The present invention relates to a decorative catering device for displaying and serving individual-serving-size food items. More particularly, the present invention relates to a combination decorative artificial plant or tree for displaying and serving appetizers.

BACKGROUND OF THE INVENTION

Restaurants, caterers and even home party hosts recognize that presentation of their culinary creations is equally as important as taste. In a constant effort to improve their image and reputation, restaurants, caterers and home party hosts often display their culinary creations in colorful arrangements using decorative food garnish. Such arrangements, however, are time consuming to prepare and usually must be disposed of after a single use. Therefore, it would be desirable to provide a device for displaying and serving appetizers which is both decorative and reusable.

In the retail food industry, stands for displaying prepackaged food items, such as candy and other snack items, are known as taught by, for example, Harris et al., U.S. Pat. No. 5,094,348, and Joaquin, U.S. Pat. No. 4,040,520. The devices disclosed by Harris and Joaquin are reusable but are not decorative and have little use by caterers, restaurants and party hosts in displaying and serving individual-serving-size food items. Therefore, it would be desirable to provide a device for displaying and serving appetizers which is not only reusable but also decorative.

Known commercial devices for displaying and serving prepackaged food items such as taught by Harris and Joaquin have other shortcomings for serving appetizers. For examples, such devices are expensive and bulky. Therefore, it would be desirable to provide a device for displaying and serving appetizers which is inexpensive, and which can readily fit into a residential dishwasher and be stored in a compact area.

SUMMARY OF THE INVENTION

It is an object of the present invention to provide a device which can be used by restaurants, caterers and home party hosts for displaying and serving individual-serving size food items such as appetizers.

It is a further object of the present invention to provide a device for displaying and serving individual-serving size food items which is decorative, durable and reusable.

It is a further object of the present invention to provide a device for displaying and serving individual-serving-size food items which is not only decorative but also capable of being repeatedly cleaned and sanitized, preferably by commercial or residential dishwashers.

It is an additional object of the present invention to provide a device for displaying and serving individual-serving-size food items which can be easily disassembled so that it can readily fit into a residential dishwasher and be stored in a compact area.

The device for displaying and serving individual-serving-size food items comprises a pedestal, a head fixed to and supported by the pedestal, and means for releasably fixing a plurality of individual-serving-size food items on the head. The pedestal has a base and an upwardly-extending support member having an upper end and a lower end fixed to the base. The base includes an open-top receptacle for containing and serving a complementary accouterment, such as a dipping sauce or marinade. The receptacle is preferably removable from the base for filling, emptying and storing the accouterment contained therein. Alternatively, the base may include a plurality of removable receptacles.

The base is made of a heavy ceramic, wood, metal or plastic material to prevent the device from tipping over. The base may have an internal cavity and a sealable port accessing the internal cavity. Ballast may be inserted into the internal cavity for added stability. Alternatively, a heated or cooled fluid material may be added to the internal cavity for heating or cooling, respectively, the accouterment contained in the receptacle(s).

The head comprises a sphere having a plurality of sockets spaced thereon. A plurality of spikes are fixed to and extend outwardly from the head. Preferably, each of the spikes is removable from the head. In one embodiment, the head is removable from the pedestal and has a flat surface portion formed thereon.

In a preferred embodiment, the device is colored and designed to look like an artificial plant or tree having a potted base, a trunk supported by and extending upwardly from the base, a bulb fixed to the upper end of the trunk, and a plurality of branches fixed to and extending outwardly from the bulb. Each of branches is constructed and arranged to releasably fix an individual-serving-size food item, such as a bite size appetizer, to the bulb. The potted base serves as an appetizer dip reservoir.

BRIEF DESCRIPTION OF THE DRAWINGS

FIG. 1 is a perspective view of a device for displaying and serving individual-serving-size food items in accordance with an embodiment of the invention;

FIG. 2 is a sectional view taken along lines 2—2 of FIG. 1;

FIG. 3 is a sectional view taken along lines 3—3 of FIG. 2;

FIG. 4 is a fragmented sectional view of the pedestal base in accordance with another embodiment of the invention;

FIG. 5 is a fragmented sectional view of the pedestal base of a further embodiment of the invention;

DETAILED DESCRIPTION OF PREFERRED EMBODIMENTS

Figure 6:
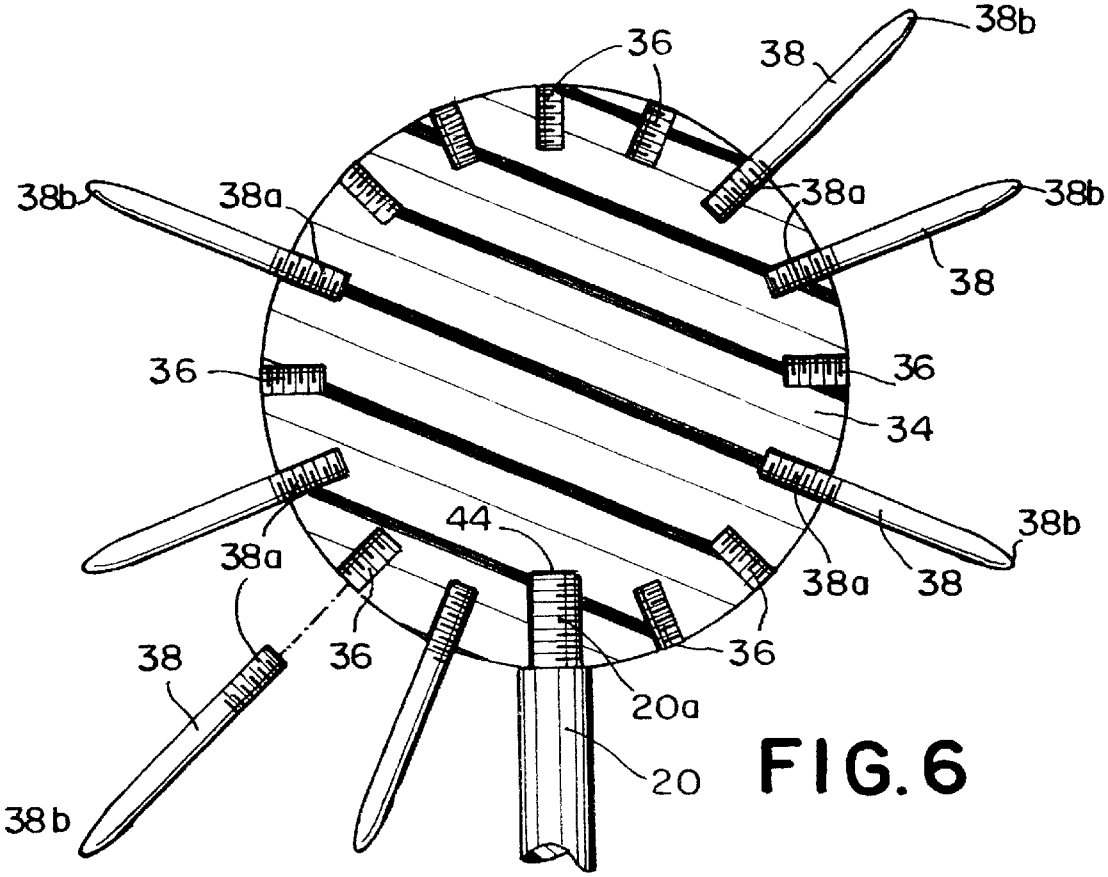
FIG. 6 is a sectional view taken along lines 6—6 of FIG. 1.

The present invention is described with reference to FIGS. 1–7 wherein like reference numerals are used to designate like elements.

A device for displaying and serving individual-serving-size food items in accordance with an embodiment of the invention is shown in FIGS. 1, 2, 3, and 6 and is designated generally by referenced numeral 10. The device shown in FIG. 1 comprises a pedestal, referred to generally by reference numeral 12, and a head, referred to generally by reference numeral 14, fixed to and supported by the pedestal 12. The head 14 includes means for releasably fixing a plurality of individual-serving-size food items on the head 14. Examples of individual-serving-size food items or appetizers are shown thereon in phantom and are designated by reference numeral 8. Such food items may include slices of fruit, vegetables, or other appetizers.

In the embodiment shown in FIGS. 1, 2, 3 and 6, the pedestal 12 comprises a base 18 and an upwardly extending support member 20 having a threaded upper end 20*a* fixed to the head 14, and a threaded lower end 20*b* fixed to the base 18. In a preferred embodiment, the base 18 has a decorative flowered pot shape and is made of a material which is heavy enough to provide stability to the device 10 when the device 10 is loaded with food items 8. For example, the base 18 may be made of wood, ceramic, clay, metal or solid plastic. The base material is preferably dishwasher safe, durable, and decorative. Referring to FIG. 3, the base 18 has a threaded, central base socket 22 which receives and connects to the threaded lower end 20*b* of the base support member 20.

Referring to FIGS. 1, 2 and 3, the base 18 preferably includes one or more removable, open-top receptacles 30 which are designed to contain and serve dip, sauce, marinade or other liquid or solid food accouterment which complements the food item 8 displayed and served on the head 14. The receptacles 30 have a shape which complements the interior of the base 18 when inserted therein. While the embodiment shown in FIGS. 1, 2 and 3 has two receptacles 30, it should be appreciated to one of ordinary skill in the art that more than two or a single receptacle 30 may be used therein. The receptacles 30 are removable from the base 18 for filling, emptying and cleaning, and may be provided with complementary lids for storing the food contained therein. It should also be appreciated that the base 18 may be heated or chilled to provide added insulation for keeping the accouterment contained in the receptacle 30 either hot or cold, respectively.

The support member 20 is fixed at its lower end 20*b* to the pedestal base 18 and at its upper end 20*a* to the head 14. The lower end 20*b* of the support member 20 is threaded to connect with the threaded base socket 22 of the base 18, as seen in FIG. 3. Referring to FIG. 6, the upper end 20*a* of the base support member 20 is also threaded to connect with a threaded socket 44 in the head 14. This modular construction allows the head 14, base 18 and support member 20 to be disassembled for cleaning and storage.

In a preferred embodiment, the head 14 comprises a spherical bulb 34 having a plurality of sockets 36 which are constructed and arranged to releasably connect a plurality of spikes 38 or stems to the bulb 34 such that the spikes 38 radially project from the bulb 34, as best seen in FIGS. 1 and 6. The sockets 36 may be equidistantly spaced on the bulb 34. Individual-serving-size food items 8 are releasably fixed to the bulb 34 by piercing the food item 8 with one of the spikes 38.

In the embodiment illustrated in FIGS. 1, 2, 3 and 6, the mounting end 38*a* of the spikes 38 and the sockets 36 are both threaded to cooperatively engage and releasably secure to one another. The spikes 38 have a pointed end 38*b* for piercing the food items 8. Since the spikes 38 are removable, the spikes 38 can be arranged in different patterns on the bulb 34 to accommodate different size and shape food items 8. The removable spikes 38 can be completely disassembled for cleaning, storage, shipment, and replacement.

In another embodiment of the invention, the device 110 has generally the same construction as described above in FIGS. 1, 2, 3 and 6. However, referring to FIG. 4, the base 118 of this embodiment of the device 110 may have a smooth base socket 122 which receives a reduced-diameter or tapered lower end portion 120*b* of a base support member 120. FIG. 4 shows a cross-section of the base 118 and a fragmented support member 120 affixed thereto. This "force fit" construction may be easier and less expensive to manufacture than the threaded lower end 20*b*/threaded base socket 22 construction described above.

In a further embodiment of the invention, the device 210 has generally the same construction as described above in FIGS. 1, 2, 3, and 6. However, referring to FIG. 5, the base 218 of this embodiment has an internal cavity 226 and a port 228 accessing the internal cavity 226. FIG. 5 shows a cross section of the base 218 and a fragmented support member 220 positioned in the center of the base 218. The port 228 is sealed with a cap 233. In this embodiment, the support member 220 is supported by the receptacles (not shown) which are positioned in the base 218. In this embodiment, the cavity 226 may be filled with ballast 231 such as sand, stone, concrete, water or the like to add additional weight to the base 218 and prevent the device 210 from toppling over. Alternatively, the internal cavity 226 may be filled with a heated or chilled ballast material or fluid, depending on the type of food item to be served in the base, which will act as a heating or cooling source, respectively.

Figure 7:
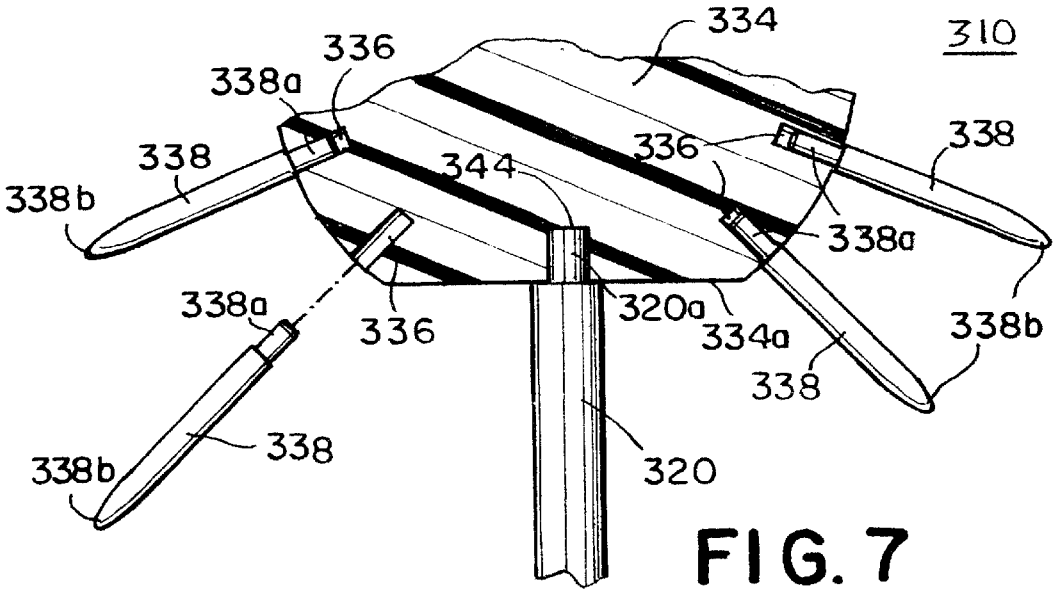
FIG. 7 is a fragmented sectional view of the bulb and support member in accordance with an additional embodiment of the invention.

In another embodiment of the invention, the device 310 has generally the same construction as described above in FIGS. 1, 2, 3, and 6. However, referring to FIG. 7, the support member 320 has a reduced diameter or tapered upper end 320*a* and the head has a smooth socket 344. FIG. 7 shows a cross section of the bulb 334 and a fragmented support member 320 affixed thereto. The upper end 320*a* of the support member 320 makes "force fit" connection in the smooth socket 344. In this embodiment, the head sockets 336 are also smooth and the mounting end 338*a* of the spikes 338 also have reduced-diameter or tapered end for a "force fit" connection with the sockets 36. In this embodiment, the spherical bulb 334 has a flat surface 334*a* formed thereon. The flat surface 334*a* allows the spherical bulb 334 to be rested on a flat surface, such as a table top, and serve as a center piece when the spherical bulb 334 is removed from the support member 320.

In each embodiment described above, the device is colored and decorated to resemble in appearance a potted flower, plant or tree. For example, graphics may be added to the outside of the pedestal base and plastic ornamentation may be wrapped around or formed on the outer surface of the base support member. As with each component described above, any coloring or decoration should be durable and dishwasher safe.

What is claimed is:

1. A device for displaying and serving individual-serving-size food items, comprising:

a) a pedestal:

b) a head fixed to and supported by said pedestal;

c) food piercing means for releasably fixing a plurality of individual-serving-size food items on said head, said food piercing means including a plurality of sockets in said head and plurality of spikes, each of said spikes being removably mounted in one of said sockets.

2. A device for displaying and serving individual-serving-size food items, comprising:

a) a pedestal;

b) a head fixed to and supported by said pedestal;

c) means for releasbly fixing a plurality of individual-serving-size food items on said head;

said releasable fixing means comprising a plurality of spikes fixed to and extending outwardly from said head;

said head comprising a sphere having a plurality of sockets spaced thereon, each of said spikes being mounted in one of said sockets.

3. The device recited in claim 2, said pedestal comprising a) a base, and b) an upwardly-extending support member having an upper end fixed to said head and a lower end fixed to said base;

4. The device recited in claim 3, said base including an internal cavity and a sealable port accessing said internal cavity, said internal cavity constructed and arranged to be filled with ballast.

5. The device recited in claim 3, said base including a removable receptacle for containing and serving a second food item which complements the individual-serving-size food items fixed to said head.

6. The device recited in claim 5, said base including an internal cavity, and means for sealing a heated or cooled fluid within said cavity to heat or cool, respectively, the second food item contained in said receptacle.

7. The device recited in claim 5, including a source for heating or cooling said receptacle.

8. The device recited in claim 5, including a plurality of removable receptacles.

9. The device recited in claim 2, said releasable fixing means comprising a plurality of spikes fixed to and extending outwardly from said head.

10. The device recited in claim 2, said head being removable from said pedestal and having a flat resting surface portion formed thereon.

11. The device recited in claim 2, said device constructed and arranged so that said head, pedestal and fixing means can be disassembled from one another.

12. A combination decorative, artificial plant and stand for displaying and serving individual-serving-size appetizers, comprising:

a) a base;

b) a trunk supported by and extending upwardly from said base;

c) a bulb fixed to the upper end of said trunk;

d) a plurality of stems fixed to and extending outwardly from said bulb, each of said stems constructed and arranged to releasably fix an individual-serving-size appetizer to said bulb;

wherein said bulb includes a plurality of sockets constructed and arranged for removable, cooperative engagement with said stems.

13. The device recited in claim 12, including an appetizer dip reservoir formed in said base.

14. The device recited in claim 13, including a plurality of removable dip reservoirs in said base.

15. The device recited in claim 13, including a source for heating or cooling said dip reservoir.

16. The device recited in claim 12, ballast means in said base to deter toppling of said device.

17. The device recited in claim 16, said ballast means comprising a sealable cavity in said base for containing water, sand, concrete or other ballast material.

18. The device recited in claim 12, said trunk comprising a cylindrical rod having a threaded lower end, said base having a threaded socket for removable, cooperative engagement with said threaded lower end.

19. The device recited in claim 12, said trunk comprising a cylindrical rod having a tapered lower end, said base having a socket for removable cooperative engagement with said tapered lower end.

20. A device for displaying and serving individual-serving-size food items, comprising:

a) a pedestal:

b) a head fixed to and supported by said pedestal;

c) means for relesably fixing a plurality of individual-serving-size food items on said head;

said pedestal comprising a) a base, and b) an upwardly-extending support member having an upper end fixed to said head and a lower end fixed to said base;

said base including a removable receptacle constructed and arranged to contain and serve a second food item which complements the individual-serving-size food items fixed to said head;

including a plurality of removable receptacles;

said base including an internal cavity and a sealable port accessing said internal cavity, said internal cavity constructed and arranged to be filled with ballast;

including means for sealing a heated or cooled fluid within said cavity to heat or cool, respectively, the second food item contained in said receptacle;

said releasable fixing means comprising a plurality of spikes fixed to and extending outwardly from said head;

said head comprising a sphere having a plurality of sockets spaced thereon, each of said spikes being mounted in one of said sockets;

said head being removable from said pedestal and having a flat resting surface portion formed thereon;

said device constructed and arranged so that said head, pedestal and fixing means can be disassembled from one another.

* * * * *